US008490828B2

(12) United States Patent
Kaiser et al.

(10) Patent No.: US 8,490,828 B2
(45) Date of Patent: Jul. 23, 2013

(54) COMESTIBLE DISPENSING PACKAGE

(75) Inventors: Richard J. Kaiser, Allentown, PA (US); Francis G. Schiro, Doylestown, PA (US); Allen Aldridge, South Orange, NJ (US)

(73) Assignee: Kraft Foods Global, Inc., Northfield, IL (US)

( * ) Notice: Subject to any disclaimer, the term of this patent is extended or adjusted under 35 U.S.C. 154(b) by 0 days.

(21) Appl. No.: 13/303,995

(22) Filed: Nov. 23, 2011

(65) Prior Publication Data

US 2012/0067916 A1 Mar. 22, 2012

Related U.S. Application Data

(63) Continuation of application No. 12/663,466, filed as application No. PCT/US2008/007138 on Jun. 6, 2008, now abandoned.

(60) Provisional application No. 60/942,628, filed on Jun. 7, 2007.

(51) Int. Cl.
*B65H 1/08* (2006.01)
*G07F 11/16* (2006.01)

(52) U.S. Cl.
USPC ..... 221/279; 221/305; 221/231; 221/281; 221/232; 221/276; 221/198; 221/226; 221/1; 206/39.3; 206/39.4; 206/39.5; 206/358; 206/800; 206/555; 206/556; 312/71; 312/42; 312/61; 453/48; 453/47; 224/196; 224/666

(58) Field of Classification Search
USPC ..... 312/71, 42, 61; 224/196, 666; 206/39.3, 206/358, 39.4, 39.5, 800, 555, 556, 39; 221/305, 221/279, 231, 281, 232, 276, 198, 226, 1; 453/48, 47
See application file for complete search history.

(56) References Cited

U.S. PATENT DOCUMENTS

| | | | | | |
|---|---|---|---|---|---|
| 1,620,808 | A | * | 3/1927 | Eldridge | 312/42 |
| 1,908,115 | A | | 5/1933 | Chadwick | |
| 2,771,214 | A | | 11/1956 | Lefebvre | |
| 2,803,378 | A | * | 8/1957 | Gundling | 221/232 |
| 3,115,989 | A | | 12/1963 | Strang | |
| 3,127,054 | A | | 3/1964 | Meyers | |
| 3,248,156 | A | * | 4/1966 | Repko | 312/71 |
| 3,286,823 | A | | 11/1966 | Gillespie | |
| 3,397,818 | A | * | 8/1968 | Rey | 221/232 |
| 3,604,562 | A | | 9/1971 | Loeffler | |
| 4,170,914 | A | * | 10/1979 | Carrier | 83/580 |
| 4,256,237 | A | | 3/1981 | Desmond | |

(Continued)

FOREIGN PATENT DOCUMENTS

| | | | |
|---|---|---|---|
| DE | 1225541 | B1 | 9/1966 |
| WO | W02006003079 | A1 | 1/2006 |

*Primary Examiner* — Gene O. Crawford
*Assistant Examiner* — Rakesh Kumar
(74) *Attorney, Agent, or Firm* — Hoffmann & Baron, LLP

(57) ABSTRACT

A package for product pieces includes a housing having a plurality of walls forming an interior adapter to hold a plurality of product pieces. The housing has a dispensing opening in communication with the interior. A resilient member is disposed in the housing interior and is adapted to urge the product pieces toward the dispensing opening. The housing has an aperture formed in one of the plurality of walls disposed adjacent the dispensing opening to permit the product piece to be engaged and moved out of the interior through the dispensing opening.

16 Claims, 6 Drawing Sheets

U.S. PATENT DOCUMENTS

| | | | | | |
|---|---|---|---|---|---|
| 4,465,208 | A | * | 8/1984 | Buban et al. | 221/279 |
| 4,586,631 | A | | 5/1986 | Loder | |
| 4,792,058 | A | * | 12/1988 | Parker | 221/232 |
| 4,887,739 | A | * | 12/1989 | Parker | 221/232 |
| 5,123,551 | A | | 6/1992 | King | |
| 5,353,956 | A | * | 10/1994 | Wilson | 221/198 |
| 5,407,094 | A | * | 4/1995 | Vajtay | 221/193 |
| 5,649,642 | A | | 7/1997 | Mabry | |
| 6,000,589 | A | * | 12/1999 | Burdine | 224/196 |
| 6,053,356 | A | | 4/2000 | Emoff et al. | |
| 6,749,084 | B2 | | 6/2004 | Thompson | |
| 7,104,420 | B2 | | 9/2006 | Maffei | |
| 2008/0302814 | A9 | | 12/2008 | Fenton | |

* cited by examiner

COMESTIBLE DISPENSING PACKAGE

CROSS-REFERENCE TO RELATEDAPPLICATIONS

This application is a continuation application of U.S. application Ser. No. 12/663,466, having a 35 USC 371(c) date of Sep. 14, 2010, which is the U.S. national phase application of PCT/US2008/007138 filed on Jun. 6, 2008 which claims the benefit of priority to U.S. Provisional Application Ser. No. 60/942,628 filed on Jun. 7, 2007. The entire disclosure of all aforementioned applications are incorporated herein by reference for all purposes.

This application claims priority to U.S. Provisional Application Ser. No. 60/942,628 filed on Jun. 7, 2007 the disclosure of which is incorporated by reference herein in its entirety.

FIELD OF THE INVENTION

The present invention relates to a dispensing package for storing and dispensing comestible items such as pieces of gum having a slab-like configuration. It is within the contemplation of the present invention that other comestible items could be dispensed.

BACKGROUND OF THE INVENTION

Chewing gum is currently available to consumers in a variety of different formats. These include stick gum, slab gum, pellet gum, extruded gum, and others. A variety of types of gum packaging also exist, including certain types of packaging used predominantly for one or the other of the gum formats. Slabs of gum have often been sold in foil packages. Originally, these slabs were arranged in a package in a side-to-side manner, perhaps including five to seven slabs per package. More recently, these slabs have been arranged within the foil packages in a face-to-face manner, allowing 15-20 slabs to be contained in a convenient package. Slabs are also offered in packages where the slabs lay side-by-side, and a cover moves between a closed and open position to permit dispensing. Such packaging typically has broad front and back surfaces on which product information can be placed.

Packaging typically includes covers which are moved to an open position to permit access to the product. However, the opening up of the cover exposes all the product pieces. Therefore, the product pieces are susceptible to falling out of the package every time one piece is removed. While this issue had been addressed by adhesively retaining the pieces in the package, the adhesive must be light enough to permit the pieces to be removed and, over time, handling of the package can cause the other pieces to separate.

Accordingly, it would be desirable to provide packaging for product pieces which permits one piece to be removed while securely retaining the other pieces.

SUMMARY OF THE INVENTION

The present invention relates to a package for product pieces.

The present invention further provides a package for dispensing individual comestible pieces.

The present invention still further provides a package for comestible products including a housing having a resilient member acting on a stack of comestible pieces and an opening for dispensing the pieces.

The present invention also provides a package for product pieces including a housing having a plurality of walls forming an interior adapter to hold a plurality of product pieces. The housing has a dispensing opening in communication with the interior. A resilient member is disposed in the housing interior and is adapted to urge the product pieces toward the dispensing opening. The housing having an aperture formed in one of the plurality of walls disposed adjacent the dispensing opening to permit the product piece to be engaged and moved out of the interior through the dispensing opening.

The present invention still further provides a package assembly including a plurality of product pieces and a housing having a plurality of walls forming an interior. The plurality of product pieces is disposed within the interior. The housing has a dispensing opening in communication with the interior. A resilient member is disposed in the housing interior and is adapted to urge the product pieces toward the dispensing opening. The plurality of housing walls include a first wall having an aperture disposed therein adjacent the dispensing opening to permit one of the product pieces to be engaged and moved out of the interior through the dispensing opening.

The present invention provides a method of dispensing a plurality of comestible product pieces including obtaining a housing forming an interior adapter to hold a plurality of product pieces. The housing has a dispensing opening in communication with the interior. A resilient member is disposed in the housing interior and is adapted to urge the product pieces toward the dispensing opening. The housing has an aperture disposed adjacent the dispensing opening to permit the product piece to be engaged and moved out of the interior through the dispensing opening. The method further includes engaging one of the product pieces through the aperture, moving the product piece through the dispensing opening, and removing the product piece from the package housing.

The present invention also provides a method of forming a package for dispensing product pieces including forming a blank and folding the blank to form a housing. The method also includes inserting a plurality of product pieces into the housing and inserting a resilient member into the housing and securing the resilient member in the housing wherein the resilient member urges the plurality of product pieces toward a dispensing position.

DETAILED DESCRIPTION OF THE PREFERRED EMBODIMENTS

The preferred embodiment of the present invention includes a package 5 for containing and dispensing a comestible product 28. In particular, the present invention may be used for containing and dispensing confectionery products such as gum pieces, hard candy, or other comestibles. While the particular embodiments shown herein are employed to contain gum pieces, it may be appreciated that the package may contain any type of product. Such product may also include other confectionery products such as gum in various sizes and shapes, such as sticks, slabs, pillows, pellets and the like, as well as other confectionery products, such as hard candy, chocolate, and the like. The product may include multiple pieces or be a single unitary piece. Also, non-confectionery products may be contained and dispensed in accordance with embodiments of the present invention.

Figure 1:
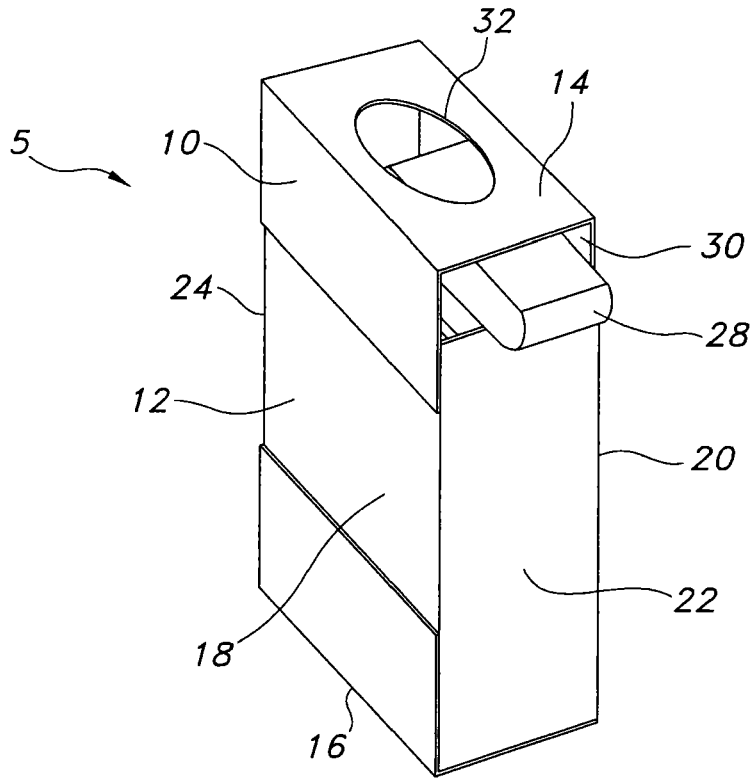
FIG. 1 is a top perspective view of a dispensing package of the present invention.
Figure 2:
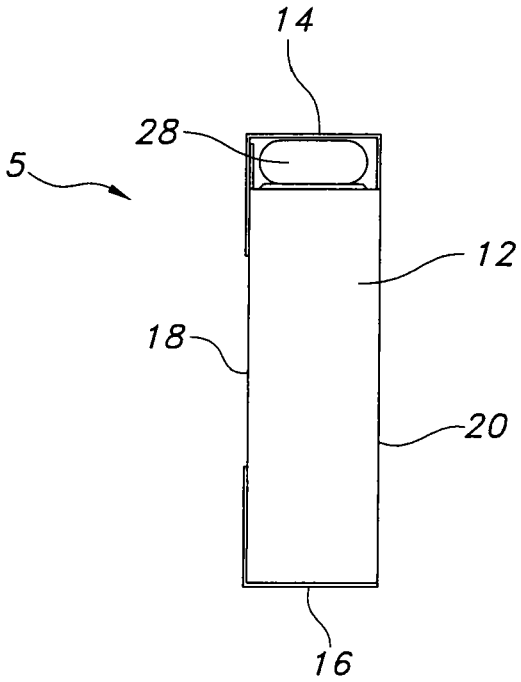
FIG. 2 is a side elevational view of the package of FIG. 1.
Figure 3:
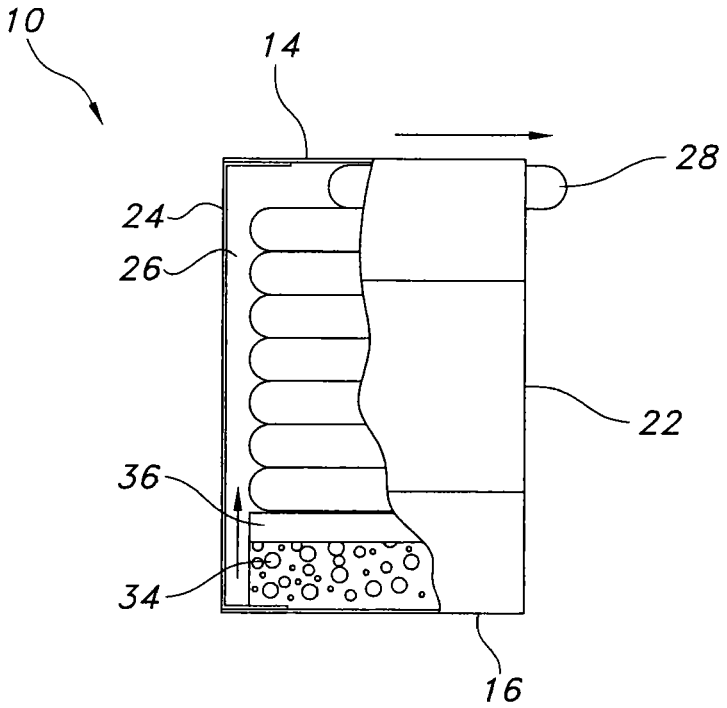
FIG. 3 is an elevational view of the package of FIG. 1 with a portion removed for illustrative purposes.

Referring to FIGS. 1 and 2, the present invention includes a package assembly 10 having a package housing 12. The package housing 12 is preferably formed of a paperboard material. However, it is within the contemplation of the present invention that the package housing 12 may be formed of a plastic or metallic material. The package housing 12 includes a top wall 14, bottom wall 16, a front wall 18, back wall 20, and a first and second side walls, 22 and 24 respectively. Top wall 14 extends between and is connected to the front 18 and back wall 20. With reference to FIG. 3, the various walls form a package housing interior 26 in which a stack of product pieces 28 are disposed one on top of the other in a face-to-face arrangement.

With reference to FIGS. 1 and 3, the package housing 12 may further include a dispensing opening 30 which is in communication with the housing interior 26. Dispensing opening 30 may be formed between top wall 14 and first side wall 22. Preferably the dispensing opening 30 may be disposed directly below the top wall 14 and is therefore located adjacent the top end of the package housing 12. Dispensing opening 30 permits the comestible to exit the package housing 12. Top wall 14 includes an access aperture 32 which permits a user to engage the product piece 28, such as with their finger, and push it out of the package through the dispensing opening 30 as will be described in more detail below. Access aperture 32 may have an elongated shape extending in the direction of product piece movement as indicated by an arrow in FIG. 3.

The package assembly 10 may be covered by a plastic over-wrap (not shown) of a type known in the art, which is removable by a user prior to dispensing the comestibles.

Figure 5:
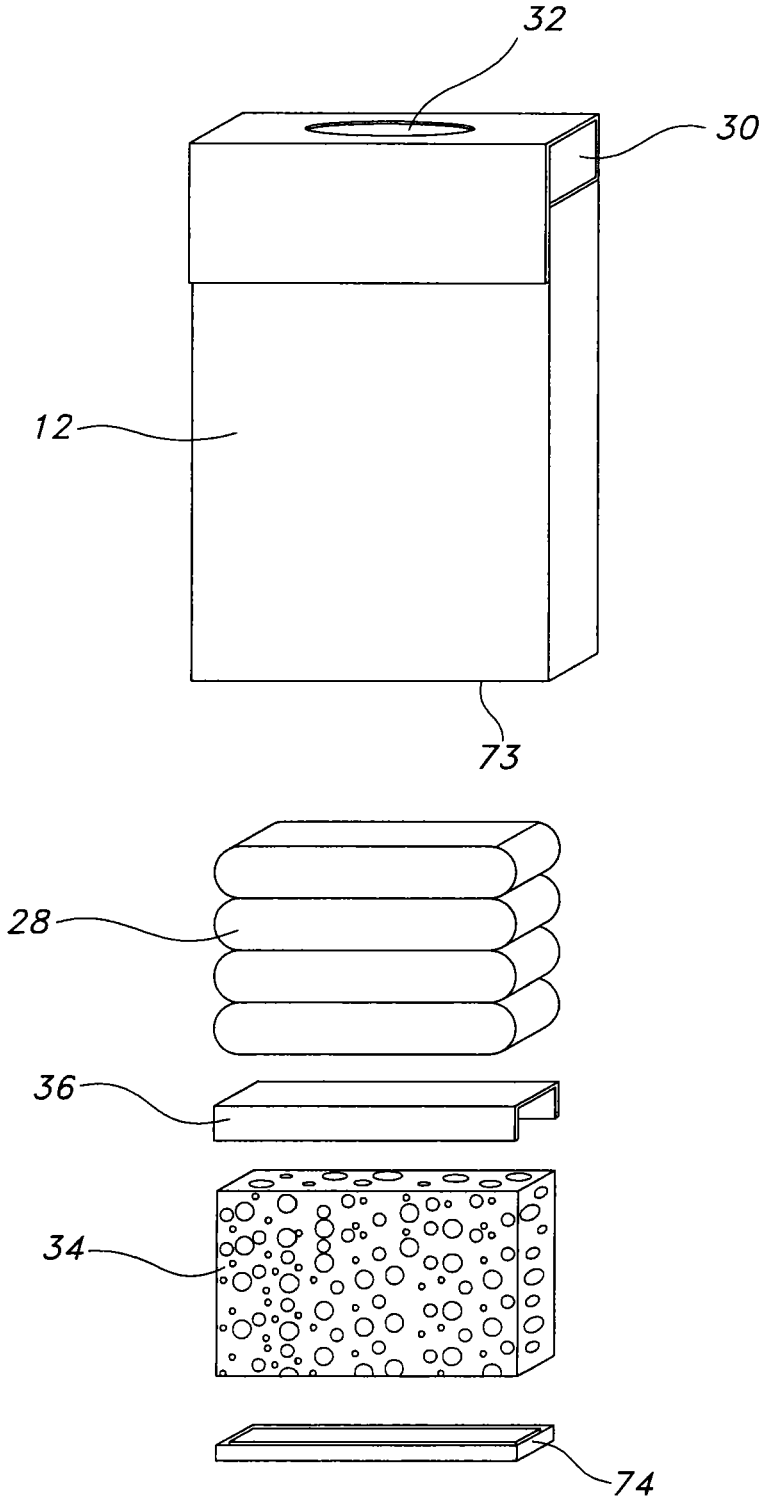
FIG. 5 is an exploded view of one embodiment of the present invention.

With reference to FIGS. 3 and 5, the package assembly 10 further includes a resilient device 34 disposed within the housing interior 26. The resilient device 34 acts against the stack of product pieces 28 and urges them toward the dispensing opening 30. The product piece adjacent the dispensing opening is in the dispensing position. In this position, a product piece 28 is accessible through the access aperture 32 and disposed adjacent the dispensing opening 30, thereby permitting dispensing. The resilient device 34 may include a piece of compressibly resilient foam, such as open cell polyurethane, or any other resilient material. A cover 36 may be positioned over the end of the resilient device adjacent the comestible. Cover 36 may be formed of paperboard or any other smooth material which permits the comestible to slide there-over. The cover 36 may have a generally U-shaped cross-section having a portion which covers the top of the foam and portions that extend partially down the sidewalls of the foam. The foam may be compressed when the comestibles are loaded into the package housing 12.

Figure 4:
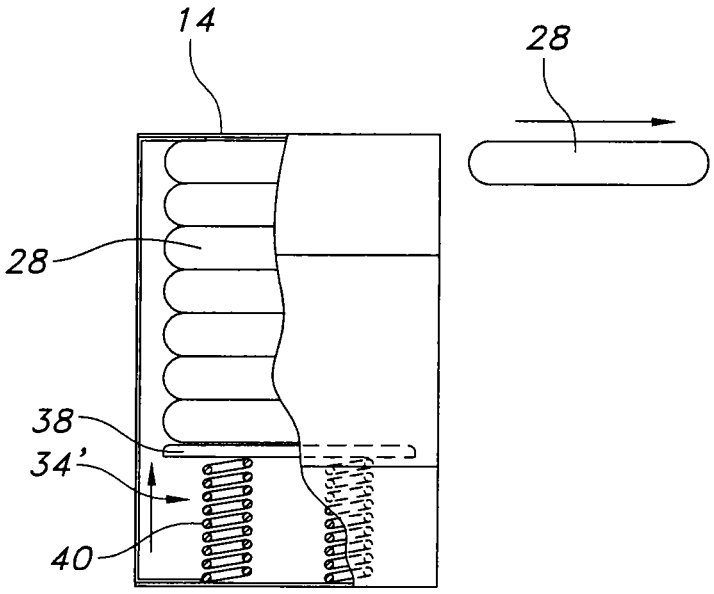
FIG. 4 is an elevational view of an alternative embodiment of a package of the present invention with a portion removed for illustrative purposes.
Figure 6:
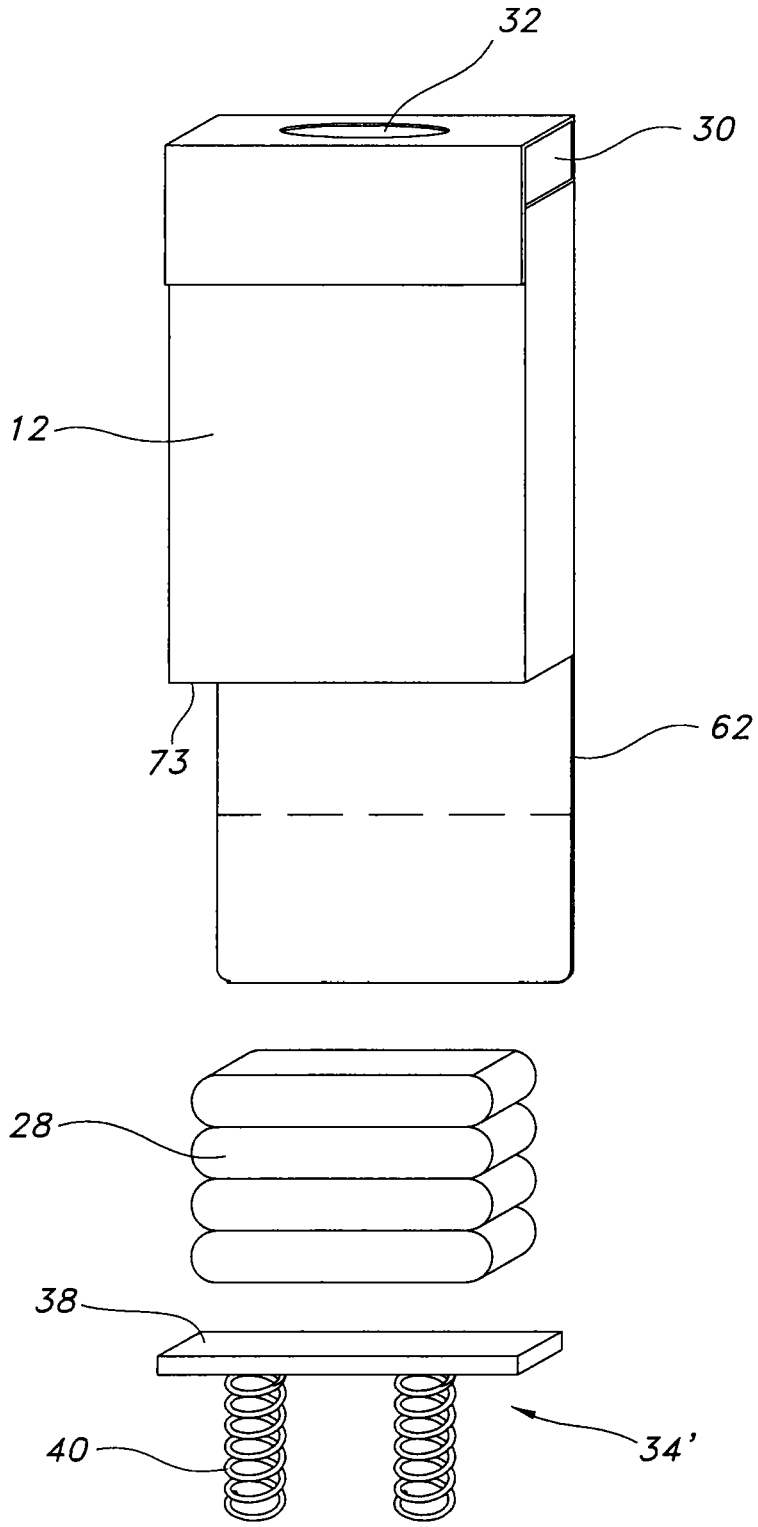
FIG. 6 is an exploded view of an alternative embodiment of the present invention.

In an alternative embodiment shown in FIGS. 4 and 6, the resilient device 34' may include a generally flat platform 38 and one or more biasing devices 40, such as compression coil springs, engaging the bottom surface of the platform 38. The biasing devices 40 may be operably coupled to the platform 38. It may be appreciated that any suitable biasing device may be employed. The platform may be formed of plastic or paperboard or other material which will permit the comestible to slide there-over.

With reference to FIGS. 1 and 3, in order to dispense the product pieces 28, a user may hold the package housing 12 and place a finger through the access aperture 32 and onto the product piece 28 lying there-beneath. Then the user may urge the product piece 28 out of the dispensing opening 30, pushing it therethrough. The product piece 28 exits the dispensing opening and the user may then grab the exposed portion of the product piece 28 to fully remove it from the package housing 12 (FIG. 4). The biasing nature of the resilient device 34, 34' causes the stack of product pieces to be moved upwardly to fill the void left by the dispensed product piece. The next product piece is then ready to be dispensed.

Figure 7:
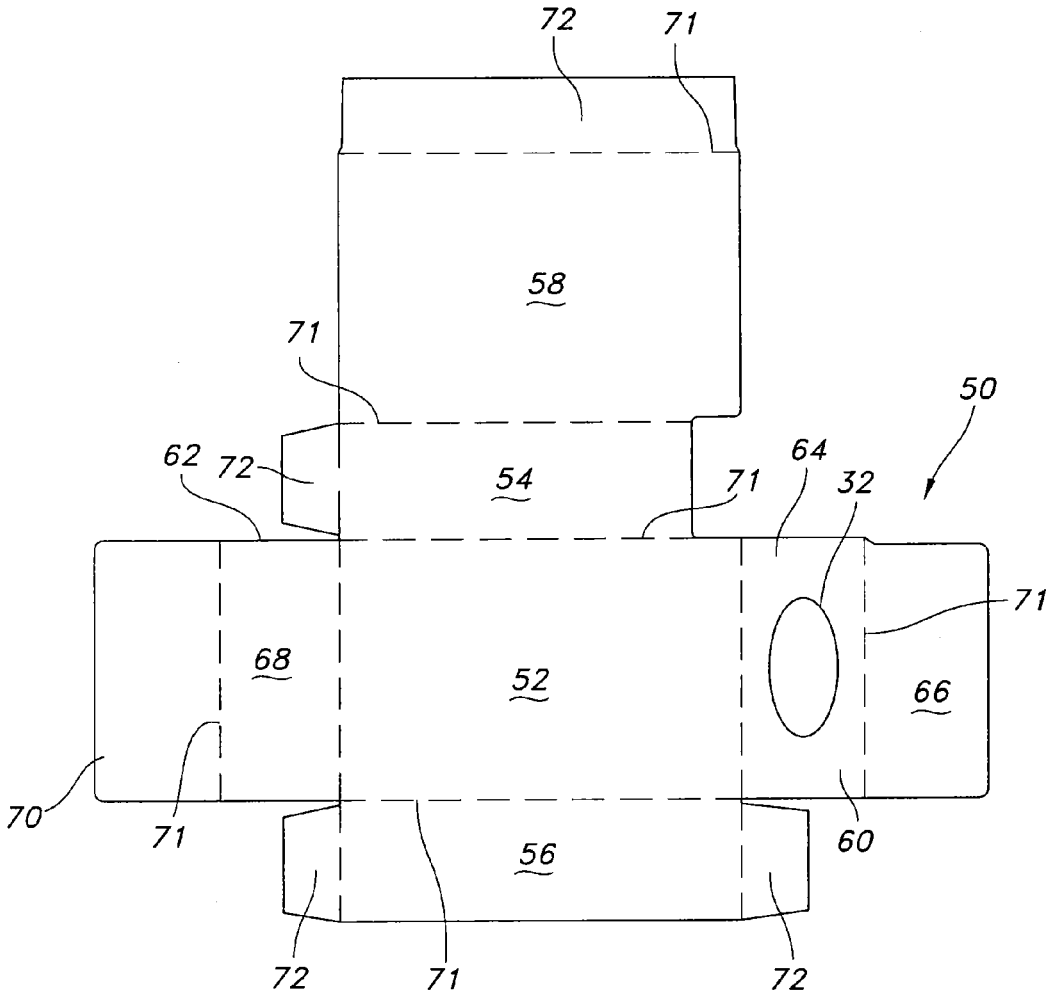
FIG. 7 is a top plan view of a blank of the present invention.

In one preferred embodiment of the present invention, the package housing 12 is formed of one piece of material such as paperboard or other foldable material. With reference to FIG. 7, a blank 50 includes various panels which may be formed by die cutting, punching or by any other manner known in the art. The various panels may be folded and glued to form the package housing 12. Blank 50 may include a back panel 52 which forms back wall 20. Extending laterally from one side of back panel 52 is a first side panel 54 which forms first side wall 22. Extending laterally from the other side of back panel 52 is a second side panel 56 which forms second side wall 24. A front wall panel 58 extending from first side wall panel 54 forms the front wall 18 of the package housing 12. Back panel 52 further includes a top panel 60 extending from an upper end and a bottom panel 62 extending from a lower end. The top panel 60 includes a first portion 64 which forms the top wall 14 of the packaging and a second portion 66 which is folded onto the front wall panel 58 and adhered thereto. The first portion 64 may have formed therein the access aperture 32. The bottom panel 62 includes a first portion 68 which forms the bottom wall 16 and a second portion 70 which is folded over and adhered to the front wall panel 58. The top panel second portion 66 and bottom panel second portion 70 may be folded over the outside surface of front wall panel 58 as shown in FIG. 1. Alternatively, panels 66 and 70 may be folded and secured to the inside of the front wall panel 58 such that the panels 66 and 70 are not visible from the outside of the package housing 12.

The various panels may be folded along fold lines 71 to form the package housing 12. The first and second side wall panels 54 and 56, back panel 52 and front panel 58 each include securement tabs 72 which are folded and secured, preferably by adhesive, to opposed surface of the package housing 12 to maintain the panels in the folded positions to form the package housing. Therefore, the package housing 12 is formed from one unitary piece of material.

In an alternative embodiment, the bottom panel 62 may be eliminated, and the bottom of the package housing may be a separate piece 74 which is secured to the package housing, such as by an adhesive, as shown in FIG. 5. While FIG. 5 shows the embodiment of the resilient device using the foam material, it is within the contemplation of the present invention that other types of resilient devices could be used.

As shown in FIGS. 5 and 6, the product pieces 28 may be loaded in the package housing interior 26 through a loading opening 73 disposed in the housing bottom. The resilient device 34 or 34' may then be placed in the housing interior 26. The bottom may then be secured to the package housing. In the embodiment where the bottom is a separate piece 74 as shown in FIG. 5, the bottom 74 can be placed in and secured to the surrounding housing walls. In the embodiment wherein the bottom is formed by the bottom panel 62 as shown in FIG.

6, the bottom panel 62 may be folded into place and secured, thereby retaining the product pieces and the compressed resilient device in the package housing. When the package is assembled, the product pieces 28 are urged toward the dispensing position. It is also within the contemplation of the present invention that the product pieces 28 could be loaded in through the top of the package housing 12 and then the top wall could be secured thereby retaining the product pieces 28 in the package housing 12.

Figure 8:
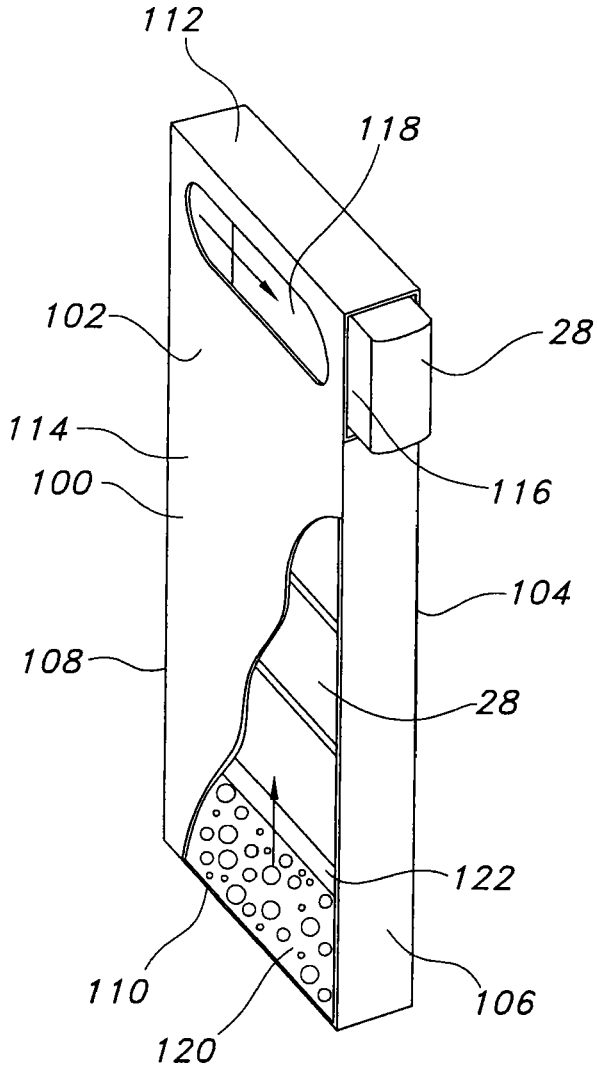
FIG. 8 is a perspective view of an alternative embodiment of the dispensing package of the present invention with a portion removed for illustrative purposes.

With reference to FIG. 8, a further alternative embodiment of the package is shown. In this embodiment, the product pieces 28 may be stacked side edge to side edge. Package housing 100 may include first and second opposed walls 102 and 104 which are joined on their sides by third and fourth walls 106 and 108 and fifth and sixth walls 110 and 112. These walls form a housing interior 114. Walls 102 and 104 may be broad panels larger in area than the walls connecting them together. A dispensing opening 116 is formed at one end of the package housing in third wall 106 and is defined by sixth wall 112 and the first and second walls 102 and 104. Access aperture 118 is formed on first wall 102 adjacent the dispensing opening 116. A resilient device 120 may be disposed within the package housing 100 to urge the product pieces 28 toward the dispensing opening 116. The resilient device may include a compressible foam material or spring or other resilient element. A cover 122 may be positioned between the resilient device and product pieces 28 to permit the pieces to slide thereover. As in the previously described embodiments, in order to dispense the product pieces 28 a user may engage the product piece through the access aperture 118 and slide it out through the dispensing opening 116. When the product piece is removed, another piece is moved into the dispensing position below the access aperture 118 and adjacent the dispensing opening 116 and is ready to be dispensed.

Having described the preferred embodiments herein, it should now be appreciated that variations may be made thereto without departing from the contemplated scope of the invention. Accordingly, the preferred embodiments described herein are deemed illustrative rather than limiting, the true scope of the invention being set forth in the claims appended hereto.

What is claimed is:

1. A package for dispensing comestible product pieces comprising:

a housing having a plurality of walls forming an interior adapted to hold a plurality of product pieces, the product pieces having a face and a side edge with the face being broader than the side edge, and the product pieces being stacked side edge-to-side edge, the housing having a dispensing opening in communication with the interior;

a resilient member disposed in the housing interior; and the plurality of walls including a resilient member support wall upon which the resilient member rests, an end wall disposed spaced from and opposite the resilient member support wall, and an access wall extending between the resilient member support wall and the end wall, the access wall including an access aperture disposed adjacent the dispensing opening, the access aperture including an elongate slot extending in a direction of product piece movement upon being dispensed from the package housing, the slot being unobstructed along its length to provide access into the housing interior and permit a user to directly contact the face of at least one of the plurality of product pieces with their finger through the access aperture to move the product pieces out of the interior through the dispensing opening, wherein the resilient member imparts a biasing force which acts to urge the product pieces toward the end wall and the dispensing opening.

2. The package as defined in claim 1, wherein the plurality of walls further includes a side wall spaced from and opposed to the access wall.

3. The package as defined in claim 2, wherein the plurality of walls further includes first and second opposed lateral walls adjoining the access wall to the side wall.

4. The package as defined in claim 3, wherein the first lateral wall has an upper extent spaced from the end wall to form the dispensing opening.

5. The package as defined in claim 3, wherein at least a portion of the access wall, side wall, end wall, and first lateral wall define a perimeter of the dispensing opening.

6. The package as defined in claim 1, wherein the resilient member includes one or more coil springs.

7. The package as defined in claim 1, wherein the resilient member includes a compressible foam member.

8. The package as defined in claim 1, wherein the access opening has a perimeter entirely bounded by the access wall.

9. The package as defined in claim 1, wherein the package housing is formed from one unitary piece of material.

10. The package as defined in claim 9, wherein the material is a paperboard material.

11. A package assembly comprising:

a plurality of comestible product pieces, the product pieces having a face and a side edge with the face being broader than the side edge, and the product pieces being stacked side edge-to-side edge;

a housing having a plurality of walls forming an interior containing the plurality of product pieces, the housing having a dispensing opening in communication with the housing interior;

a resilient member disposed in the housing interior; and the plurality of walls including a resilient member support wall upon which the resilient member rests, an end wall disposed opposite the resilient member support wall, and an access wall extending between the resilient member support wall and the end wall, the access wall including an access aperture disposed adjacent the dispensing opening, wherein the user directly contacts the face of at least one of the plurality of product pieces with their finger through the access aperture to push the at least one product piece out of the dispensing opening, and wherein the resilient member imparts a biasing force which acts to urge the plurality of product pieces toward the end wall and the dispensing opening.

12. The package as defined in claim 11, wherein the at least one of the plurality of product pieces is disposed adjacent the dispensing opening and is urged by the resilient member against an inner surface of the end wall.

13. The package as defined in claim 11, wherein the end wall has a uniform and substantially uninterrupted surface.

14. The package as defined in claim 11, wherein the product pieces are disposed adjacent to each other forming a stack having a length and the access wall extends along the length of the stack.

15. The package as defined in claim 11, wherein the housing is formed of a single integrally formed piece of paperboard material.

16. A method of dispensing a plurality of comestible product pieces comprising:

obtaining a housing having a plurality of walls forming an interior adapter to hold the plurality of product pieces, the plurality of product pieces having a face and a side edge with the face being broader than the side edge, and the product pieces being stacked side edge-to-side edge, the housing having a dispensing opening in communication with the interior;

a resilient member disposed in the housing interior; and the plurality of walls including a resilient member support wall upon which the resilient member rests, an end wall disposed opposite the resilient member support wall, and an access wall extending between the resilient member support wall and the end wall, the access wall including an access aperture disposed adjacent the dispensing opening, the access aperture permitting the product pieces to be engaged and moved out of the interior through the dispensing opening, wherein the resilient member imparts a biasing force which acts to urge the plurality of product pieces toward the end wall and the dispensing opening;

directly contacting the face of one of the plurality of product pieces with one's finger through the access aperture;

moving the product piece through the dispensing opening; and removing the product piece from the package housing.

* * * * *